United States Patent [19]

Royer

[11] 4,282,689

[45] Aug. 11, 1981

[54] PORTABLE DOOR COVERING FOR INDOOR HEAT SAVINGS

[76] Inventor: George R. Royer, 2137 Ragan Woods Dr., Toledo, Ohio 43614

[21] Appl. No.: 68,060

[22] Filed: Aug. 20, 1979

[51] Int. Cl.[3] ..... E04H 1/12

[52] U.S. Cl. ..... 52/79.6; 49/68; 49/40; 49/67

[58] Field of Search ..... 52/65, 79.6; 49/68, 49/40, 67

[56] References Cited

U.S. PATENT DOCUMENTS

| | | | |
|---|---|---|---|
| 242,059 | 5/1881 | Scott | 49/40 |
| 617,308 | 1/1899 | Cobb | 49/68 |
| 841,696 | 1/1907 | Lang | 49/68 |
| 931,502 | 8/1909 | Schureman | 49/40 |
| 2,074,872 | 3/1937 | Thorn | 52/201 |
| 3,348,345 | 10/1967 | Byers | 52/79.6 |
| 3,955,322 | 5/1976 | Call | 49/68 |
| 3,999,334 | 12/1976 | Webb | 52/107 |

*Primary Examiner*—Price C. Faw, Jr.
*Assistant Examiner*—Henry E. Raduazo

[57] ABSTRACT

A portable door covering device for placement inside or outside a door leading to the outside of a building, said device being so placed as a permanent or temporary structure during colder months in order to minimize the escape of the heat contained indoors to the outside areas. The device is comprised basically of a semicylindrical member of hollow disposition, said member being open on the one side thereof for placement against the walls near the door area, and the other side being enclosed and equipped with a conventional door to allow access to areas inside the door covering device.

2 Claims, 4 Drawing Figures

PORTABLE DOOR COVERING FOR INDOOR HEAT SAVINGS

DISCUSSION OF PRIOR ART

The prior art is replete with a myriad variation of door devices for ingress and egress to and from a building, said door device being constructed in such a way so as to maintain the heat content inside a building and minimize the loss of heated air to the outside. Conversely, such a device is also structured so as to keep cold air from entering into the inside of a building. Such door devices are well known in the art, and for example one such type of device is a cylindrical structure encasing a revolving door arrangement. Revolving door devices have been seen as part of entrance structure to buildings, and while these enclosed revolving doors are ostensibly structured additionally for other than heat preservation purposes, they do serve as a heat conservator of a relatively high degree of efficiency.

Additionally, there are indeed many types of door variations which serve to preserve the warm air content in a residential building to minimize losses of heat through a doorway when opened for ingress and egress purposes. However, in residential homes there are no known devices which are of a temporary nature for positioning adjacent an access door during the colder months to minimize the loss of heat to the outside.

In this latter aspect, one of the greatest heat losses from a building is through a door exposed directly to the outside from a heated interior. This direct exposure obviously causes significant heat losses when one opens such a door and exposes an open doorway, as the relatively warm air will escape to the outside areas once the doorway is open and exposed, or conversely colder air from the outside will enter such doorway causing a drop in air temperature for air inside.

Therefore, the subject invention is conceived as a temporary and portable device for placement in a doorway to minimize heat losses from a building, and the subject invention is directed to the end of providing a temporary door covering device for residences during the winter months.

OBJECTS

In view of the foregoing discussion of the prior art the following are objects of the subject invention;

It is an object of the subject invention to provide an improved door covering device for a door in a building exposed to outside areas for purposes of preserving the heat in a building;

Yet another object of the subject invention is to provide a device for aiding in the process of preserving the heat content of a building;

Still another object of the subject invention is to provide an improved door covering of a temporary nature on a building to enable one to minimize heat losses to areas outside the building;

A further object of the subject invention is to provide a removable structure to cover doors, whether inside or outside to prevent heat losses;

A still further object of the subject invention is to provide an improved door covering device of a temporary nature;

Another object of the subject invention is to provide an improved door covering device;

Yet another object of the subject invention is to provide an improved heat conservation device;

Other and further objects of the subject invention are to provide an improved exit and entrance device for a building;

Yet another object of the invention herein is to provide an improved doorway device.

Other and further objects of the subject invention will become manifest from a reading of the following description in conjunction with the drawings.

DESCRIPTION OF GENERAL EMBODIMENT

The subject invention is a door covering device for temporary placement in front of a door in a building which is exposed to outside areas of the building interior. The device is conceived as a temporary covering having its own entrance and exit means. The subject device is a semicylindrical structure with a hollow interior. There is an enclosed ceiling on the top of the device so as to enclose the upper part thereof.

More specifically, the subject device is basically a member which is configured as a hollow cylinder cut in half from top to bottom, so that a hollow semi-cylindrical member is created, with the one vertical side thereof (the back) is open, the remaining vertically extending curved wall portion is closed as it extends from each side of the open back portion. The top of the subject device is closed, and by virtue of the foregoing structural arrangement, the subject device becomes an enclosed hollow structure when the open, back side is emplaced against the wall adjacent each side of the door.

The front, curved wall portion of the device has integrally affixed therein a pivotable door in a doorway in order to allow a person to enter the hollow interior of the device before exiting through the building door which the device covers.

DESCRIPTION OF PREFERRED EMBODIMENT

Figure 1:
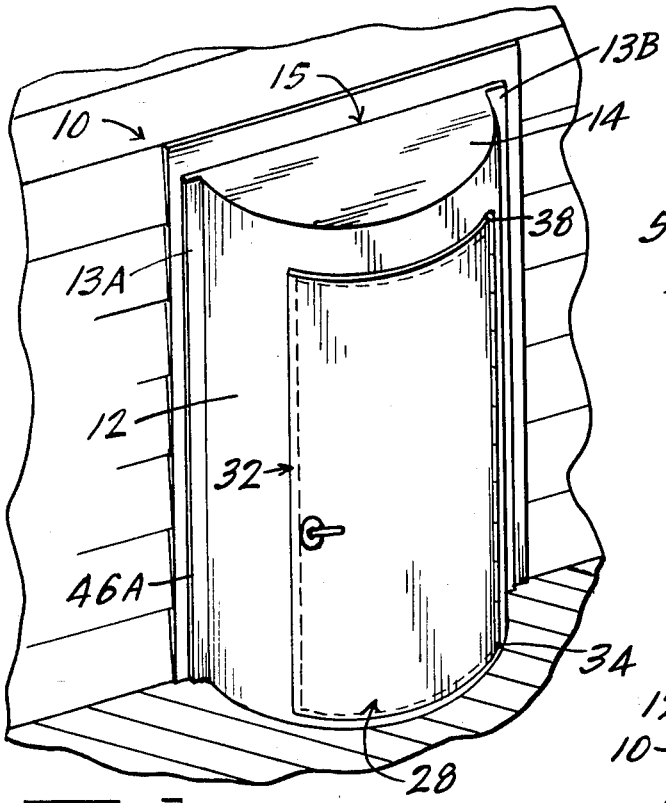
FIG. 1 is a perspective and schematic view of the subject invention.
Figure 4:
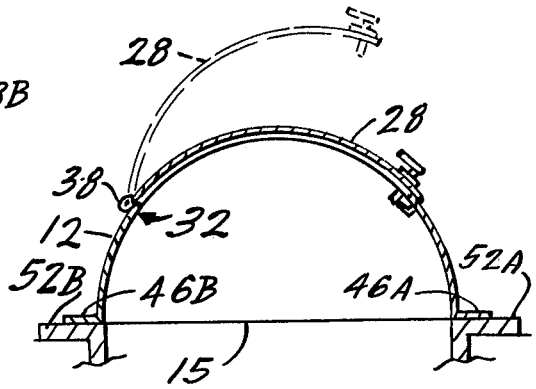
FIG. 4 is a top elevational view of the subject invention in section through line A—A of FIG. 3.
Figure 2:
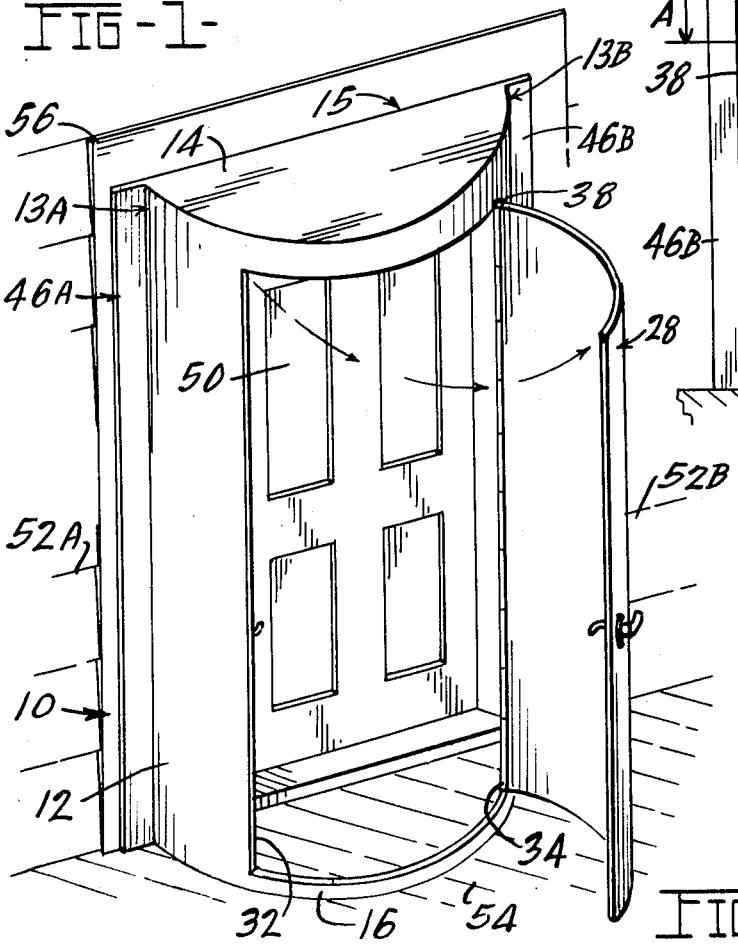
FIG. 2 is an enlarged perspective view, partially in phantom, of the view shown in FIG. 1.

Referring now to the drawings in which a preferred embodiment of the subject invention is shown, a door covering device 10 is shown in FIGS. 1 and 2. The door covering device 10 is a preferably semipermanent door fixture which is juxtapositioned either in front of a house door; and in this regard it can be placed on the outside in front of a door or alternatively it can be positioned inside the house over the door, as represented in the drawings. It must be noted that the subject device can be placed in front of or behind any door for any type of building for purposes of conserving heat, with the understanding that its primary utility is generally directed to placement by doors leading out of buildings outside areas.

In the use of the subject door covering device 10, it must be indicated that the need to maintain the heated air inside a home with auxiliary doorway devices presents some special problems for most residential buildings, as any door covering device is usually too large or cumbersome to be placed and permanently maintained inside a home. Generally, with the relatively small size of the rooms in a home, a door covering structure such as device 10 cannot occupy too much space, since this space as occupied by such a door covering may serve to crowd an already small room. However, in colder months when heat loss problems are most critical, a temporary structure may be more readily tolerated for short winter month durations. Then when the extreme winter weather has passed, such a temporary structure can be removed for storage purposes. The door covering device 10 shown in the drawings is thus conceived as a structure to block the outflow of heat from a room to areas on the outside of the building which outside areas are in direct communication with the inside of the room through the door sought to be covered. The device 10 eliminates the problem of heated air escaping directly through the outside, as the device serves as an intermediate protective covering.

It should be noted that the device 10 can be comprised of any substance, however, for purposes of constructing the preferred embodiment, a plastic material is preferable. Moreover, it is desirable to use a material that is either transparent or translucent so that one can see through it to the doorway covering.

Now, in specific reference to the structure and placement of the door covering device 10, attention is directed specifically to FIGS. 1 and 2 which represents a perspective view of the preferred embodiment of the subject door covering device 10. Device 10 is preferably structured as a semicylindrical member of generally hollow disposition, as shown. More particularly, the door cover device 10 is essentially a vertical section (or half) of a hollow cylinder, as if the cylinder was sliced downwardly and vertically through the middle thereof so as to produce two separate identical halves, each mutually symmetrical. By such a structure the device 10 comprises a vertical member, the one vertical wall 12 of which is curved in an arc of approximately one hundred and eighty degrees, extending to diametrically opposed vertical edges 13A and 13B, as shown in FIGS. 1 and 2. The curved wall 12 is referred to as the frontal portion of the device 10, while the posterior portion 15 is open as it extends between vertical edges 13A and 13B. The interior of the device 10 is hollow, with the bottom being open without a flooring and being adapted to rest on the floor. The upper part of device 10 is covered with a solid ceiling 14 as shown, and as stated, it is not essential that there be a bottom or floor in the lower part adjacent bottom edge 16 on frontal wall 12.

Figure 3:
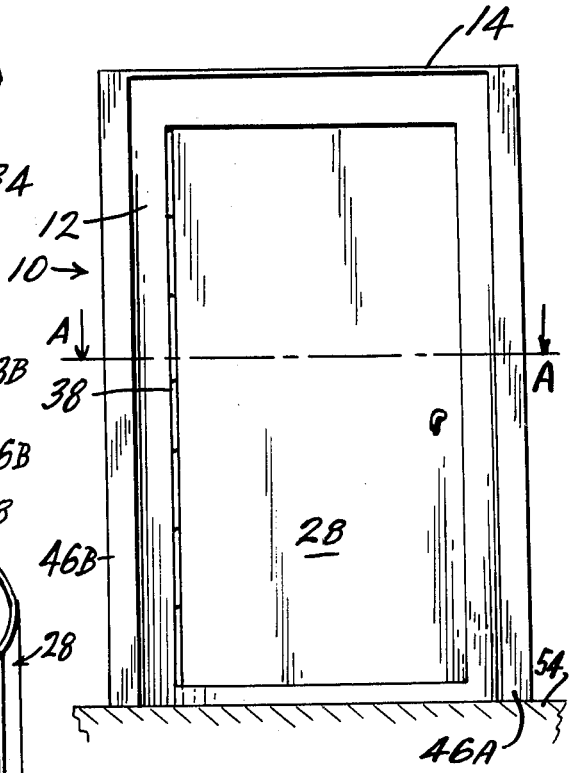
FIG. 3 is a front elevational view of the subject invention.

Integrated into the curved wall 14 of the device 10 is a doorway 32, into which is pivotally mounted a pivotable door 28 adapted to swing frontally or forwardly on pivot points 34 and 38 from the closed position shown in FIG. 1 to the open position shown in FIG. 3. This door 28 is adapted to open to allow access through doorway 32 into the interior areas of the door covering device 10, as obviously surmised by analysis of the drawings. It is preferable that the door 28 open outwardly and frontally away from the hollow interior region as shown in FIG. 3. When the device 10 is positioned against a building door, it is desirable to keep door 28 closed so that heat does not escape into the interior of the device 10.

On each side of the cover device 10, are flanged wall extensions 46A and 46B as shown in FIG. 2. More particularly, these flanges wall extensions 46A and 46B are rectangularly shaped flaps which extend laterally from that portion of the device where the curved wall 12 ends on each side of the cover device 10 at edges 13A and 13B, as readily seen in FIGS. 1 and 2. Such flaps 46A and 46B are optional features.

The subject cover device is utilized by placement thereof against the wall 52A and 52B on each side of a door 50, which leads to areas outside of the building, as particularly represented in FIG. 2. The house door 50 is shown as a door which swings or pivots in conventional pivotal fashion either inwardly or outwardly as it leads to space outside the building, said outside space representing a zone obviously not heated and which contains relatively colder air experienced in winter months.

The device 10 is emplaced by the door 50 with edges 13A and 13B positioned vertically against adjoining walls 52A and 52B, as shown, and such that the back 15 rests flush along the wall 52 with the bottom edge 16 resting on floor 54 of the building with the upper cover 14 positioned beneath the upper room ceiling 56, as represented. The open back 15 area of the covering device 10 is placed so that it completely covers the building door 50 as represented. In such position the curved wall portion 12 of cover device 10 is faced opposite or away from the building doorway 50, as that the hollow space of device 10 will lie between the doorway 50 and the curved frontal wall 12. Moreover, if the flanged side extensions 46A and 46B are used, they are juxtaposed in a flush manner against the side walls 52A and 52B which adjoin each side of the doorway 54, as seen in FIG. 2. The device 10 can be attached in some way to the walls 52A and 52B or simply emplaced firmly there against. Also, the enclosed ceiling 14 will extend up over the doorway 54 and away therefrom. By such placement over the doorway the door cover will completely encapsulize the door entrance 54 thereby keeping the doorway insulated and somewhat isolated as practical matter from the rest of the room. As can be seen, the covering device 10 is only a temporary or semi-permanent emplacement over the doorway and can be removed after the winter months have passed.

Now while a specific structure has been described it is not to be construed as limiting the scope of the following claims, as other variations of shape, size, structure, and proportions are envisioned in the subject invention.

I claim:

1. A portable door covering formed of one continuous piece of transparent plastic material for heat savings inside a building, said door covering device being adapted for placement in front of the building door leading to areas outside the building, and wherein said door covering device has a frontal area and back portions respectively for placement orientation and wherein said door covering device comprises:

(a) a vertically extending member having a continuous frontal wall on the frontal area, and wherein said vertically extending member has a hollow portion open to spatial areas outside said vertically extending member, and wherein the hollow portion is open towards the back of said vertically extending member, and wherein the back portion of said vertically extending member is placed with one of each side thereof being on opposite sides of the building door with the hollow portion thereof facing a portion of the building door, said vertically extending member having flanged vertical sides in each side of said back wall for placement of said flanged sides flush against the adjacent building wall, (b) openable and closable doorway means in said frontal continuous wall in the frontal area of said vertically extending member to provide exit and entrance means between said hollow portion and said frontal portion of said vertically extending member.

(c) a separately formed pivotable door in said doorway means to allow openings of closure of said doorway means.

2. A portable door covering formed of one continuous translucent plastic piece for heat savings inside a building, said door covering device being adapted for placement in front of the building door leading to areas outside the building and wherein said door covering device has a frontal area and back portions respectively for placement orientation and wherein said door covering device comprises:

(a) a vertically extending member of semicylindrical shape, said vertically extending member having a concave identation in the back area, with the concave indentation adapted for emplacement by the door of said building door, said vertically extending member having vertically disposed flanged extensions on each side of the back to rest be disposed against the building walls on each side of doorway of building.

(b) doorway means in said vertically extending member, said doorway means leading from the frontal area of said vertically extending member to back concave portion of said vertically extending member.

(c) a pivotable door disposed in said doorway means to allow opening and closure of said doorway means.

* * * * *